US005100257A

United States Patent [19]

Centa

[11] Patent Number: 5,100,257

[45] Date of Patent: Mar. 31, 1992

[54] MANHOLE COVERS WITH ATTACHMENT MEANS FOR DECORATIVE STRIPS

[76] Inventor: Anthony R. Centa, Howe Green Lane, Little Berkhamsted, Hertford SG13 8LH, England

[21] Appl. No.: 571,600

[22] PCT Filed: Feb. 17, 1989

[86] PCT No.: PCT/GB89/00171

§ 371 Date: Aug. 23, 1990

§ 102(e) Date: Aug. 23, 1990

[87] PCT Pub. No.: WO89/08168

PCT Pub. Date: Sep. 8, 1989

[30] Foreign Application Priority Data

Feb. 27, 1988 [GB] United Kingdom ..... 8804652

[51] Int. Cl.[5] ..... E01C 29/14

[52] U.S. Cl. ..... 404/25

[58] Field of Search ..... 404/25, 26

[56] References Cited

U.S. PATENT DOCUMENTS

| | | | |
|---|---|---|---|
| 139,938 | 6/1873 | Williams | 404/25 |
| 2,431,082 | 2/1945 | Sayles | 404/26 |
| 2,593,918 | 4/1952 | Redman | 404/26 |
| 3,217,619 | 11/1965 | Driver et al. | 404/25 |
| 3,975,870 | 8/1976 | Naka | 404/25 X |
| 4,143,988 | 3/1979 | Arment | 404/26 |
| 4,237,666 | 12/1980 | Kohaut | 404/25 X |
| 4,637,725 | 1/1987 | Centa | 404/25 |
| 4,751,799 | 6/1988 | Ditcher et al. | 404/25 X |
| 4,828,274 | 5/1989 | Stannard | 404/25 X |
| 4,834,574 | 4/1989 | Bowman | 404/26 |

*Primary Examiner*—Ramon S. Britts
*Assistant Examiner*—Nancy P. Connolly
*Attorney, Agent, or Firm*—Davis, Bujold & Streck

[57] ABSTRACT

An access cover for a manhole of the kind in which the removable cover member fits within an outer surrounding frame (2), the cover being in the form of an inner frame (5) containing an appropriate filling material (11), such as concrete. The appearance of the upper edges of the inner and outer frames is enhanced by providing the upper edges with decorative strips (12) which are positively fixed to the upper edges of the frame members (2, 6) by a tongue and groove joint (21, 22). Preferably, the groove (21) is formed with at least one splayed-out wall (20) which, after assembly, is pressed into longitudinal engagement with a corresponding wall of the tongue (22). An insulating layer (23) can be provided to prevent any chemical reaction between the frames and strips when they are of dissimilar metals.

7 Claims, 2 Drawing Sheets

MANHOLE COVERS WITH ATTACHMENT MEANS FOR DECORATIVE STRIPS

This invention relates to access covers for manholes of the kind in which a removable cover member fits within an outer frame, the cover member also being fabricated as a frame (hereinafter referred to as an inner frame) which is filled with concrete or other appropriate material. An access cover of this kind is described and claimed in my U.K. Patent Specification No. 2,145,138.

In said Patent Specification the outer and inner frames are fabricated from frame members which are cut to length to suit the opening to be covered. It will be appreciated that, once in position, only the upper edges of the frame members of the inner and outer frames are visible. The inner and outer frames described in my said Patent Specification are preferably of aluminium, which enables the frame members to be formed as an extrusion suitably cut to length. However, it may be that the appearance of the upper edges provided by the frame members does not blend in with the surroundings, or suit the aesthetic requirements of the designer.

An object of this invention is to provide an arrangement in which these upper edges can be readily provided to suit the intended surroundings.

According to this invention, an access cover for manholes of the kind discussed above is characterised in that the upper edges of the frame members are shaped to provide a keying surface to which decorative strips having a mating surface are affixed, said keying and mating surfaces providing at least one co-operating tongue and groove.

Preferably, the cooperating tongue and groove is generally of dovetail form in cross-section, i.e. the corresponding side walk at least on one side of the tongue and groove are inclined, or shaped, to provide a positive fixing against being pulled apart.

In some applications, particularly where two disimilar materials are used for the frame members and decorative strips, a chemical reaction may be expected, e.g. galvanic corrosion between frame members of aluminium alloys and strips of copper alloys, an interposing protective insulating layer may be provided.

Where the frame members and strips are fixed together via a dovetail tongue and groove, preferably one of the side walls defining the groove is splayed outwardly during forming so that, during assembly, the cooperating tongue and groove can be readily fitted together and the side wall thereafter crimped inwardly into longitudinal engagement with the corresponding side wall of the tongue to provide said positive fixing.

Figure 1:
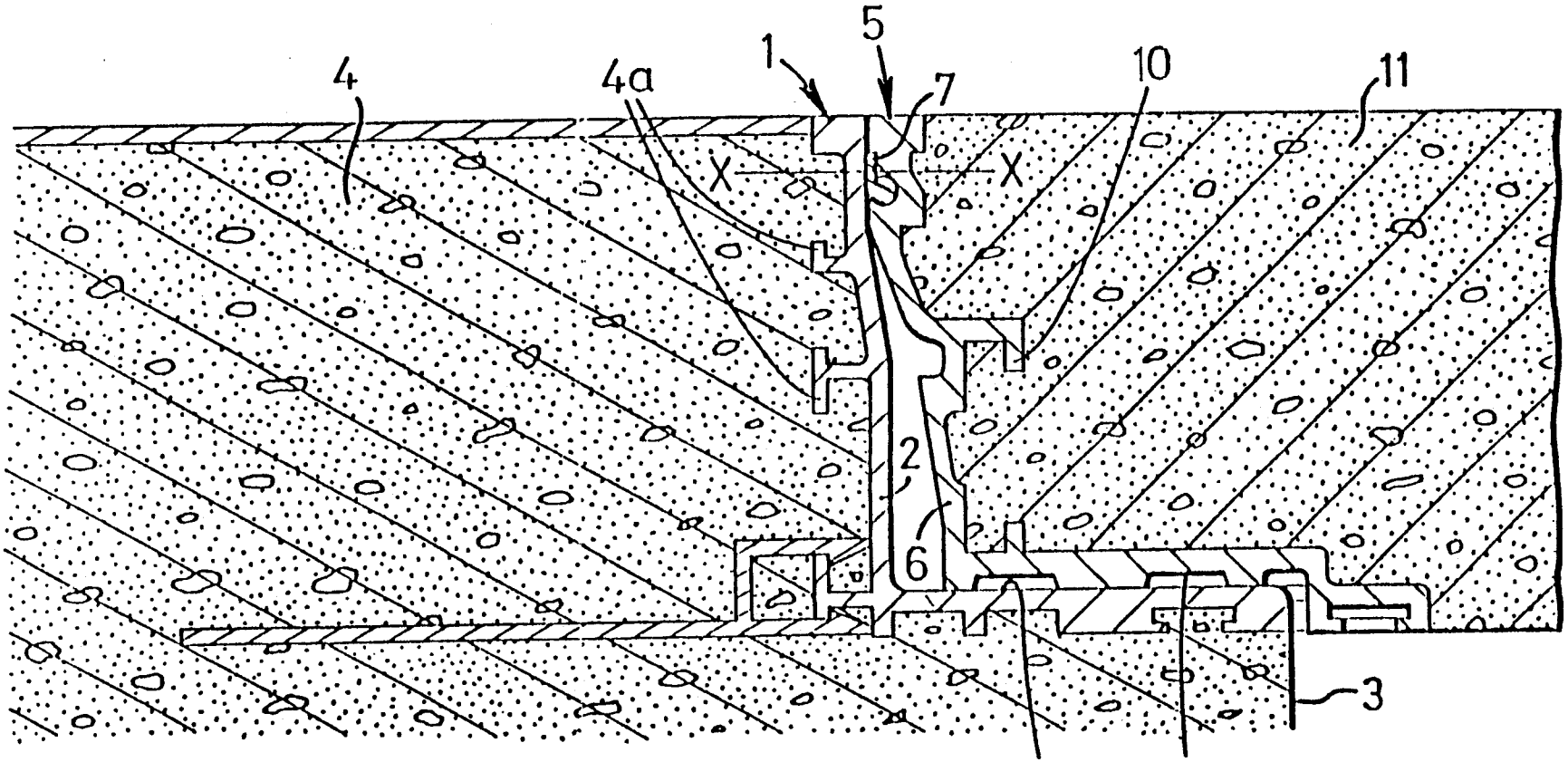
FIG. 1 PRIOR ART
Figure 2:
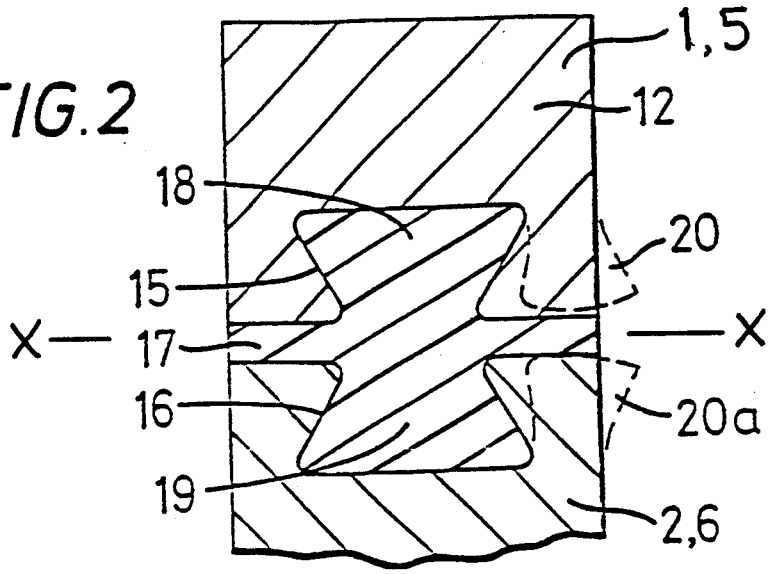
Figure 3:
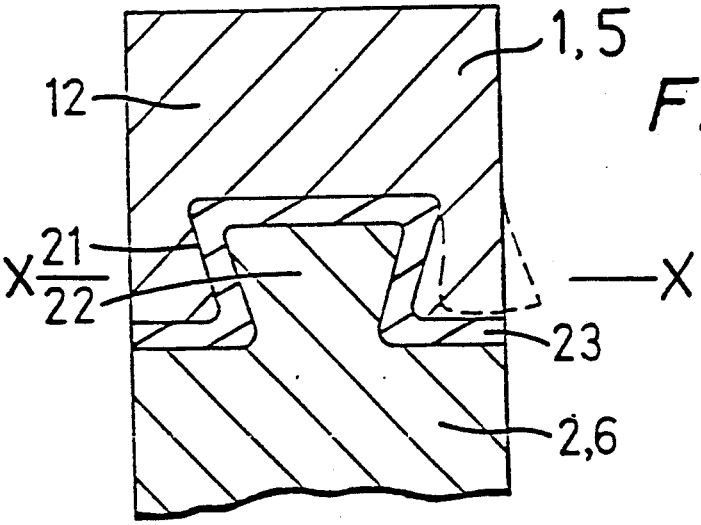
Figure 4:
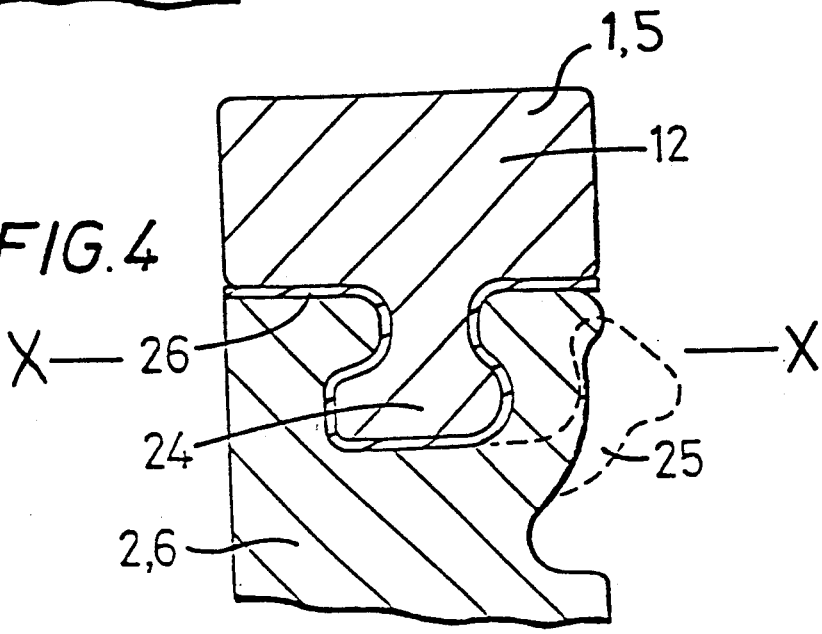

In order that the invention may be readily understood, three embodiments will now be described with reference to the accompanying drawings, in which:

FIG. 1 is a section through a prior art access cover and outer frame generally as described in my said Patent Specification, and FIGS. 2 to 4 respectively are enlarged modified views of upper edges 1, 5 of FIG. 1 illustrating three embodiments of the present invention.

Referring to FIG. 1, the access cover is preferably rectangular in plan and has an outer frame 2 comprising four a L-shaped frame member, which is located over a wall 3 partially defining an opening and fixed in position by concrete 4 via keying flanges 4*a* formed along the rear faces of the frame members. The inner frame 5 is similarly formed from an L-shaped frame member 6 which are a snug fit within the outer frame members, particularly around the upper edges thereof where the frames are sealed together by a sealing strip 7. The horizontal limbs of the inner frame members 6 each have a grooved lower surface 8 which sits on the upper surface 9 of the respective horizontal limb of the outer frame members 2. The inner frame members 6 also have keying flanges 10 in their rear faces to fix the concrete filling material 11 within the frame.

In accordance with this invention the upper edge of the frame members 2, 6 comprise decorative strips 12 (see FIGS. 2 to 4) applied thereto, according to requirements. These strips are joined to the frame members approximately along the line X—X and may either be of metal, e.g. a copper alloy, or of a suitable plastics material of an appropriate colour.

Referring to FIGS. 2 to 4, the embodiments described are in respect of frame members 2, 6 of aluminium and decorative strips 12 of brass.

Referring to FIG. 2, in the first embodiment, the frame members and strips each have a symmetrical dovetail groove 15, 16 formed therein and an interposing layer 17 is provided as a reinforced plastics extrusion with co-operating dovetail shaped tongues 18, 19 projecting from each of its faces. The components may be fixed by forming the decorative strip 12 and frame member with a respective splayed-out side wall 20, 20*a* which can be crimped against the corresponding side wall of the co-operating dovetail tongue. In this way other fixing means, such as an adhesive is not required for positive fixing. If preferred, the strip and the frame member can each be formed with both side walls splayed-out, which are then crimped from respective sides into engagement with their respective tongues.

Referring to FIG. 3, in the second embodiment, a symmetrical dovetail groove 21 is formed in the strip 12 and a co-operating tongue 22 in the frame member and the two metals are separated from each other by a suitably shaped plastics extrusion 23, or insulating tape. As in the first embodiment, the components may be fixed together by crimping. However, it will be appreciated that only the strip 12 would be provided with a splayed-out side wall, or walls.

Referring to FIG. 4, in the third embodiment, an assymmetrical dovetail joint is provided, having differently shaped side walls, the groove being formed in the frame member and cooperating tongue 24 in the decorative strip 12. This arrangement facilitates interposing the insulation layer 26, which in this case is insulating tape, by adhering one side of the tape onto and around the tongue 24 before it is fitted into the groove, which has only one shaped, splayed-out wall 25, which is shaped to mate with the shape of its corresponding tongue side wall.

It will be appreciated that, in a production line, the frame members and decorative strips would be formed by joining extruded lengths of frame member and strip section together and then cutting them to lengths appropriate to the dimensions required for the outer and inner frames. Where the section(s) have splayed-out walls, crimping would be effected by traversing along the length of each splayed-out wall with a pressure roller or rollers to move the wall into longitudinal contact with its corresponding tongue side wall.

I claim:

1. An access cover for manholes in which a removable cover member fits within an outer frame, the cover member being fabricated as an inner frame which is filled with concrete or other appropriate material, wherein at least one upper edge of the inner and outer frame members is shaped to provide a keying surface to which a decorative strip having a mating surface is affixed, said keying and mating surfaces provide at least one cooperating tongue and groove, the groove is defined by two side walls and is of a dovetail form in cross-section, and one of the side walls is malleably deformable whereby said one side wall is formed splayed-outwardly to facilitate assembly of the cooperating tongue with the groove and whereby said one side wall may thereafter be crimped inwardly into longitudinal engagement with the corresponding side wall of the tongue to provide a positive fixing of the tongue with its corresponding groove.

2. An access cover according to claim 1, wherein the tongue and the groove are symmetrical in cross-section, and the groove is provided on the decorative strip and the tongue is provided on one of the frame members.

3. An access cover according to claim 1, wherein the tongue and the grove are asymmetrical in cross-section, and the two side walls defining the groove are of different shape.

4. An access cover according to claim 3, wherein the tongue is formed on the decorative strip.

5. An access cover as claimed in claim 1, wherein a protective insulating layer is provided between the upper edge of one of the frame members and the decorative strip to prevent any chemical reaction between the decorative strip and the frame member.

6. An access cover as claimed in claim 5, wherein the insulating layer is in the form of a tape which is adhered on one side onto and around the tongue before the tongue is fitted into its cooperating groove.

7. An access cover for manholes in which a removable cover member fits within an outer frame, the cover member being fabricated as an inner frame and filled with concrete or other appropriate material, wherein upper edges of both the inner and outer frame members are shaped to provide keying surfaces to which decorative strips having mating surfaces are affixed, each of said keying and mating surfaces provides at least one cooperating tongue and groove, each groove is defined by two side walls and is of a dovetail form in cross-section, and one of the side walls of each groove is malleably deformable whereby each said one side wall is formed splayed-outwardly to facilitate assembly of each said cooperating tongue with its associated groove and whereby each said one side wall may thereafter be crimped inwardly into longitudinal engagement with its associated tongue to provide a positive fixing of each tongue with its corresponding groove.

* * * * *